US005378577A

United States Patent [19]

Smith et al.

[11] Patent Number: 5,378,577

[45] Date of Patent: * Jan. 3, 1995

[54] PHOTOGRAPHIC LIGHT-SENSITIVE ELEMENTS

[75] Inventors: Dennis E. Smith; John L. Muehlbauer, both of Rochester, N.Y.

[73] Assignee: Eastman Kodak Company, Rochester, N.Y.

[ * ] Notice: The portion of the term of this patent subsequent to Feb. 22, 2011 has been disclaimed.

[21] Appl. No.: 968,801

[22] Filed: Oct. 30, 1992

[51] Int. Cl.[6] ..... G03C 1/32

[52] U.S. Cl. ..... 430/138; 430/523; 430/531; 430/536; 430/537; 430/631; 430/950; 430/961

[58] Field of Search ..... 430/138, 950, 523, 537, 430/536, 631, 961, 220, 531, 107, 110

[56] References Cited

U.S. PATENT DOCUMENTS

| | | | |
|---|---|---|---|
| 2,932,629 | 4/1960 | Wiley . | |
| 2,976,250 | 3/1961 | Walford . | |
| 3,206,312 | 9/1965 | Sterman et al. . | |
| 3,428,451 | 2/1969 | Trevoy . | |
| 3,920,456 | 11/1975 | Nittel et al. . | |
| 4,022,622 | 5/1977 | Timmerman et al. . | |
| 4,148,741 | 4/1979 | Bayley | 427/219 |
| 4,203,769 | 5/1980 | Guestaux | 430/631 |
| 4,232,117 | 11/1980 | Naoi et al. | 430/539 |
| 4,235,959 | 11/1980 | Thijs et al. | 430/531 |
| 4,264,707 | 4/1981 | Uozumi et al. | 430/275 |
| 4,275,103 | 6/1981 | Tsubusaki et al. | 430/67 |
| 4,394,441 | 7/1983 | Kawaguchi et al. | 430/524 |
| 4,396,706 | 8/1983 | Ishii et al. | 430/403 |
| 4,409,322 | 10/1983 | Ezaki et al. | 430/523 |
| 4,495,276 | 1/1985 | Takimoto et al. | 430/527 |
| 4,833,060 | 5/1989 | Nair et al. | 430/110 |
| 4,855,219 | 8/1989 | Bagchi et al. | 430/496 |
| 4,914,012 | 4/1990 | Kawai | 430/536 |
| 4,965,131 | 10/1990 | Nair et al. | 430/137 |
| 4,975,363 | 12/1990 | Cavallo et al. | 430/637 |
| 4,980,267 | 12/1990 | Taber | 430/382 |
| 4,999,276 | 3/1991 | Kuwabara et al. | 430/264 |
| 5,057,407 | 10/1991 | Okamura et al. | 430/531 |
| 5,223,383 | 6/1993 | Maier et al. | 430/523 |
| 5,288,598 | 2/1994 | Sterman et al. | 430/496 |

FOREIGN PATENT DOCUMENTS

| | | | |
|---|---|---|---|
| 62-017742 | 1/1987 | Japan | 430/537 |
| 62-040463 | 2/1987 | Japan | 430/950 |
| 62-089957 | 4/1987 | Japan | 430/950 |
| 62-249172 | 10/1987 | Japan | 430/107 |

OTHER PUBLICATIONS

*Research Disclosure* 17643; Dec. 1978 pp. 22–31.
*Research Disclosure* 22534, Jan. 1983 pp. 20–58.

*Primary Examiner*—Janis L. Dote
*Attorney, Agent, or Firm*—Robert A. Gerlach

[57] ABSTRACT

Photographic elements having at least one light-sensitive layer and at least one layer having polymeric matte particles surrounded by a layer of colloidal inorganic particles.

18 Claims, No Drawings

PHOTOGRAPHIC LIGHT-SENSITIVE ELEMENTS

BACKGROUND OF THE INVENTION

Field of the Invention

This invention relates to silver halide photographic light-sensitive elements and more particularly to a method of forming images wherein the silver halide photographic light-sensitive element contains a matting agent.

Finely divided materials with a mean particle size of from about 1 to about 10 micrometers are commonly used as matting agents to provide a rough surface to photographic elements. See, for example, U.S. Pat. Nos. 4,855,219 and 4,022,622. Further, U.S. Pat. Nos. 4,396,706 and 5,057,407 provide matte particles and techniques in order to increase the adhesion of the particles to the photographic element during processing of the element. In addition to the problems expressed in the previously recited references, printer dusting is also an objectionable problem associated with inadequate matte adhesion.

It has been heretofore known to use silica particles having a average particle size of 1 to 10 micrometers as mattes for use in photographic elements. In this regard, note U.S. Pat. Nos. 4,022,622; 2,976,250; 3,920,456; 4,409,322; and 4,396,706. The use of silica particles as matting agents in photographic films suffer from a number of disadvantages: they produce an objectionable, slightly milky appearance, their average grain size cannot be closely controlled, they adhere to wall surfaces and therefore give rise to extensive cleaning of equipment and increased labor costs and they settle out in the coating device and supply pipes, thus rendering impossible the precise metering of given quantities to the coating formulation. In addition to the above, the use of colloidal silica in conjunction with matte is disclosed in U.S. Pat. Nos. 4,975,363; 4,914,012; and 4,232,117.

U.S. Pat. No. 4,235,959 suggests the use of matte particles prepared by condensing in an aqueous medium urea and formaldehyde while vigorously stirring the mixture until particles comprising urea-formaldehyde resin and silica are formed wherein the silica is embedded within the resin matrix.

SUMMARY OF THE INVENTION

The invention contemplates a photographic element having at least one light-sensitive layer on a support, the light-sensitive element containing a layer containing polymer matte particles surrounded by a layer of inorganic colloidal particles. The matte particles or beads in accordance with this invention can be included in any layer of the photographic element, but preferably are included in the top-most surface of a light-sensitive silver halide photographic element, in a separate layer over the top surface of the photographic element or in a layer in close proximity to the top-most layer so that the matte particles protrude above the surface of the top-most or outer-most layer. The matte particles are included in a suitable binder, such as, gelatin and the like. The polymeric matte particles, which are surrounded by a layer of colloidal inorganic particles, have a mean diameter ranging from about 0.5 to about 10 micrometers and preferably from about 1 to about 5 micrometers and most preferably from about 1 to about 3.5 micrometers.

Photographic elements in accordance with this invention demonstrate improved processing characteristics in modern rapid development apparatus with respect to matte adhesion, printer dusting, lack of haze and improved back side abrasion.

DETAILED DESCRIPTION OF THE INVENTION

As previously indicated, the matte particles in accordance with this invention include a polymeric core material surrounded by a layer of colloidal inorganic particles. Any suitable colloidal inorganic particles can be used to form the particulate layer on the polymeric core, such as, for example, silica, alumina, alumina-silica, tin oxide, titanium dioxide, zinc oxide mixture thereof and the like. Colloidal silica is preferred for several reasons including ease of preparation of the coated polymeric particles and improved adhesion of the matte particles to the photographic element during processing. For the purpose of simplification of the presentation of this invention, throughout the remainder of this specification colloidal silica will be used as the "colloidal inorganic particles" surrounding the polymeric core material, however, it should be understood that any of the colloidal inorganic particles may be employed. Any suitable polymeric material or mixture of polymeric materials capable of being formed into particles having the desired size may be employed in the practice of this invention to prepare matte particles for use in photographic elements, such as, for example, olefin homopolymers and copolymers, such as polyethylene, polypropylene, polyisobutylene, polyisopentylene and the like; polyfluoroolefins such as polytetrafluoroethylene, polyvinylidene fluoride and the like, polyamides, such as, polyhexamethylene adipamide, polyhexamethylene sebacamide and polycaprolactam and the like; acrylic resins, such as polymethylmethacrylate, polyacrylonitrile, polymethylacrylate, polyethylmethacrylate and styrenemethylmethacrylate or ethylene-methyl acrylate copolymers, ethylene-ethyl acrylate copolymers, ethylene-ethyl methacrylate copolymers, polystyrene and copolymers of styrene with unsaturated monomers mentioned below, polyvinyltoluene cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, polyvinyl alcohol, polyvinyl acetal, ethylene-vinyl acetate copolymers ethylene-vinyl alcohol copolymers, and ethylene-allyl copolymers such as ethylene-allyl alcohol copolymers, ethylene-allyl acetone copolymers, ethylene-allyl benzene copolymers ethylene-allyl ether copolymers, ethylene-acrylic copolymers and polyoxy-methylene, polycondensation polymers, such as, polyesters, including polyethylene terephthalate, polybutylene terephthalate, polyurethanes and polycarbonates. In some applications for photographic elements it is desirable to select a polymer or copolymer that has an index of refraction that substantially matches the index of refraction of the material of the layer in which it is coated.

As indicated above, the most preferred mean particle size of the matte particles is from about 1 to about 3.5 micrometers. The mean diameter is defined as the mean of the volume distribution. For best results, the matte particles should be less than 5,000 parts per million of particles having a diameter greater than about 5 micrometers and less than 300 parts per million of particles having a diameter greater than about 8 micrometers.

Any suitable method of preparing polymeric particles surrounded by a layer of colloidal silica may be used to prepare the matte bead particles for use in accordance with this invention. For example, suitably sized polymeric particles may be passed through a fluidized bed or heated moving or rotating fluidized bed of colloidal silica particles, the temperature of the bed being such to soften the surface of the polymeric particles thereby causing the colloidal silica particles to adhere to the polymer particle surface. Another technique suitable for preparing polymer particles surrounded by a layer of colloidal silica is to spray dry the particles from a solution of the polymeric material in a suitable solvent and then before the polymer particles solidify completely, passing the particles through a zone of colloidal silica wherein the coating of the particles with a layer of the colloidal silica takes place. Another method to coat the polymer particles with a layer of colloidal silica is by Mechano Fusion.

A still further method of preparing the matte particles in accordance with this invention is by limited coalescence. This method includes the "suspension polymerization" technique and the "polymer suspension" technique. In the "suspension polymerization" technique, a polyaddition polymerizable monomer or monomers are added to an aqueous medium containing a particulate suspension of colloidal silica to form a discontinuous (oil droplets) phase in a continuous (water) phase. The mixture is subjected to shearing forces by agitation, homogenization and the like to reduce the size of the droplets. After shearing is stopped an equilibrium is reached with respect to the size of the droplets as a result of the stabilizing action of the colloidal silica stabilizer in coating the surface of the droplets and then polymerization is completed to form an aqueous suspension of polymer particles in an aqueous phase having a uniform layer thereon of colloidal silica. This process is described in U.S. Pat. Nos. 2,932,629 and 4,248,741 incorporated herein by reference.

In the "polymer suspension" technique, a suitable polymer is dissolved in a solvent and this solution is dispersed as fine water-immiscible liquid droplets in an aqueous solution that contains colloidal silica as a stabilizer. Equilibrium is reached and the size of the droplets is stabilized by the action of the colloidal silica coating the surface of the droplets. The solvent is removed from the droplets by evaporation or other suitable technique resulting in polymeric particles having a uniform coating thereon of colloidal silica. This process is further described in U.S. Pat. No. 4,833,060 issued May 23, 1989, assigned to the same assignee as this application herein incorporated by reference.

In practicing this invention, using the suspension polymerization technique, any suitable monomer or monomers may be employed such as, for example, styrene, vinyl toluene, p-chlorostyrene; vinyl naphthalene; ethylenically unsaturated mono olefins such as ethylene, propylene, butylene and isobutylene; vinyl halides such as vinyl chloride, vinyl bromide, vinyl fluoride, vinyl acetate, vinyl propionate, vinyl benzoate and vinyl butyrate; esters of alphamethylene aliphatic monocarboxylic acids such as methyl acrylate, ethyl acrylate, n-butylacrylate, isobutyl acrylate, dodecyl acrylate, n-octyl acrylate, 2-chloroethyl acrylate, phenyl acrylate, methyl-alphachloroacrylate, methyl methacrylate, ethyl methacrylate and butyl methacrylate; acrylonitrile, methacrylonitrile, acrylamide, vinyl ethers such as vinyl methyl ether, vinyl isobutyl ether and vinyl ethyl ether; vinyl ketones such as vinyl methylketone, vinyl hexyl ketone and methyl isopropyl ketone; vinylidene halides such as vinylidene chloride and vinylidene chlorofluoride; and N-vinyl compounds such as N-vinyl pyrrole, N-vinyl carbazole, N-vinyl indole and N-vinyl pyrrolidone divinyl benzene, ethylene glycol dimethacrylate, mixtures thereof; and the like.

In the suspension polymerization technique, other addenda are added to the monomer droplets and to the aqueous phase of the mass in order to bring about the desired result including initiators, promoters and the like which are more particularly disclosed in U.S. Pat. Nos. 2,932,629 and 4,148,741, both of which are incorporated herein in their entirety.

Useful solvents for the polymer suspension process are those that dissolve the polymer, which are immiscible with water and which are readily removed from the polymer droplets such as, for example, chloromethane, dichloromethane, ethylacetate, vinyl chloride, methyl ethyl ketone, trichloromethane, carbon tetrachloride, ethylene chloride, trichloroethane, toluene, xylene, cyclohexanone, 2-nitropropane and the like. A particularly useful solvent is dichloromethane because it is a good solvent for many polymers while at the same time, it is immiscible with water. Further, its volatility is such that it can be readily removed from the discontinuous phase droplets by evaporation.

The quantities of the various ingredients and their relationship to each other in the polymer suspension process can vary over wide ranges, however, it has generally been found that the ratio of the polymer to the solvent should vary in an amount of from about 1 to about 80% by weight of the combined weight of the polymer and the solvent and that the combined weight of the polymer and the solvent should vary with respect to the quantity of water employed in an amount of from about 25 to about 50% by weight. The size and quantity of the colloidal silica stabilizer depends upon the size of the particles of the colloidal silica and also upon the size of the polymer droplet particles desired. Thus, as the size of the polymer/solvent droplets are made smaller by high shear agitation, the quantity of solid colloidal stabilizer is varied to prevent uncontrolled coalescence of the droplets and to achieve uniform size and narrow size distribution of the polymer particles that result. The suspension polymerization technique and the polymer suspension technique herein described are the preferred methods of preparing the matte particles having a uniform layer of colloidal silica thereon for use in the preparation of light-sensitive photographic elements in accordance with this invention. These techniques provide particles having a predetermined average diameter anywhere within the range of from 0.5 micrometer to about 150 micrometers with a very narrow size distribution. The coefficient of variation (ratio of the standard deviation) to the average diameter, as described in U.S. Pat. No. 2,932,629, referenced previously herein, are normally in the range of about 15 to 35%.

The mattes made in accordance with this invention strongly adhere to the film thus eliminating the problems of processing solutions scumming and printer dusting. Also, the matting agents in accordance with the invention have unexpectedly improved backside abrasion such as that generally observed when silica mattes are employed.

In this invention, the matting agent is generally incorporated into the outermost layer of a light sensitive material, however, as indicated above, the matting agent can be incorporated into any layer of the light sensitive element. By outermost layer is meant either the emulsion side surface protecting layer or a backing layer or both. However, it is particularly preferable to allow to incorporate the matting agent in the surface protecting layer.

Another advantage of the matting agents of this invention is that equipment such as, dissolution tanks and the like used in the process of production are washed with ease because the matting agent does not adhere firmly to the wall surfaces.

The matting agent is employed in an amount to achieve a coverage of from about 2 to about 500 mg per square meter.

Should the matte particles, in accordance with this invention, be incorporated in a separate overcoat protective layer, any suitable binder may be used such as, gelatin, polymers and the like. However, the use of gelatin as a binder is particularly favored.

As for gelatin, any kinds of gelatin, for example, alkali-processed gelatin, acid-processed gelatin, enzyme-processed gelatin, gelatin derivatives and denatured gelatins, are usable.

Further, the outermost layer of this invention may optionally contain a hardening agent, a smoothing agent, a surface active agent, an antistatic agent, a thickener, polymers, an ultraviolet ray absorbent, a high boiling point solvent, silver halides, a formalin capturing agent, a polymer latex and various other additives.

Examples of a hardening agent employable in this invention includes aldehyde series compounds, active halogen-containing compounds such as 2-hydroxy-4,6-dichloro-1,3,5-triazine, vinyl sulfone series compounds, N-methylol series compounds, halogencarboxyaldehyde compounds such as mucochloric acid, and so on.

As a surface active agent, any kind of surface active agents, for example, natural surface active agents such as saponin, nonionic surface active agents such as polyalkyleneoxide; cationic surface active agents such as higher alkylamines, quaternary ammonium salts and so on; anionic surface active agents containing acidic groups such as carboxylic acid, sulfonic acid and so forth may be employed.

As an antistatic agent, the outermost layer may contain surface active agents as described above, alkali metal salts of styrene-maleic acid series copolymers and acrylonitrile-acrylic acid series copolymers, and antistatic agents as described in U.S. Pat. Nos. 3,206,312; 3,428,451; metal oxides, such as $V_2O_5$, $SnO_2$, $ZnO_2$, $TiO_2$, antimony doped $SnO_2$ and the like. Suitable metal oxides are set forth in U.S. Pat. Nos. 4,203,769; 4,264,707; 4,275,103; 4,394,441; 4,495,276; 4,999,276 and so forth.

Photographic elements in which the particles of the invention can be utilized generally comprise at least one light-sensitive layer, such as a silver halide emulsion layer. This layer may be sensitized to a particular spectrum of radiation with, for example, a sensitizing dye, as is known in the art. Additional light-sensitive layers may be sensitized to other portions of the spectrum. The light sensitive layers may contain or have associated therewith dye-forming compounds or couplers. For example, a red-sensitive emulsion would generally have a cyan coupler associated therewith, a green-sensitive emulsion would be associated with a magenta coupler, and a blue-sensitive emulsion would be associated with a yellow coupler. Other layers and addenda, such as antistatic compositions, subbing layers, surfactants, filter dyes, protective layers, barrier layers, development inhibiting releasing compounds, and the like can be present in photographic elements of the invention, as is well-known in the art. Detailed description of photographic elements and their various layers and addenda can be found in the above-identified *Research Disclosure* 17643 and in James, *The Theory of the Photographic Process,* 4th, 1977.

Photographic elements suitable for use in combination with the overcoat layer containing matte particles in accordance with this invention are disclosed in *Research Disclosure* 22534, January 1983, which is incorporated herein by reference. Further, the light sensitive elements disclosed in U.S. Pat. No. 4,980,267, fully incorporated herein by reference, are particularly applicable to protection by the overcoat layers in accordance with this invention.

It is, at times, desirable to include in the layer containing the matte particles in accordance with this invention, an amount of polymeric emulsion polymerized latex particles to improve adhesion during processing. Suitable polymeric latex particles have a diameter of from about 0.01 to 0.5 μm, preferably from about 0.02 to about 0.1 μm and are employed in an amount of from about 10 to about 75 weight percent, preferably from about 25 to about 50 percent by weight based on the weight of the gelatin present in the layer. Suitable monomers for use in the preparation of latex homopolymers or copolymers include, for example, methyl acrylate, methyl methacrylate, 2-acrylamido-2-methyl propane sulfonic acid, styrene, butyl methacrylate, 2-methacryloyloxyethyl-1-sulfonic acid-sodium salt, vinylidene chloride, itaconic acid, acrylonitrile, acrylic acid, n-butyl acrylate, 2-[N,N,N-trimethyl ammonium] ethyl methacrylate methosulfate and the like. Particularly, suitable copolymers include polymethyl acrylate-co-2-acrylamido-2-methylpropane sulfonic acid (96:4), styrene-co-butylmethacrylate-co-2-methacryloyloxyethyl-1-sulfonic acid-sodium salt, methyl acrylate-co-vinylidene chloride-co-itaconic acid, acrylonitrile-co-vinylidene chloride-co-acrylic acid, n-butyl acrylate-co-methylmethacrylate, acrylonitrile-co-vinylidene chloride-co-2[N,N,N,-bimethyl ammonium] ethyl methacrylate methosulfate and the like.

It is also, at times, desirable to employ as the polymer for the matte particles one that has a refractive index that closely matches that of the binder for the layer containing the particles. For example, if gelatin is the binder, a polymer or copolymer having a refractive index as close to 1.54, as possible, will result in improved light transmission of the layer and thus improved characteristics for the photographic element. A copolymer of vinyl toluene and methyl methacrylate of about equal parts by weight provides an index of refraction substantially identical to gelatin.

The invention is further illustrated by the following examples:

EXAMPLE 1

Suspension Polymerization

Preparation I 15 g of Vazo 67 sold by DuPont Co. are dissolved in 1500 g of vinyltoluene. In a separate container, 2500 g of distilled water are added. To the water, 0.45 g potassium dichromate, 31 g poly(2-methyl-aminoethanol) adipate (MAEA) and 275 g Ludox TM (colloidal silica sold by DuPont Co.) are added. The monomer solution is combined with the aqueous solution and stirred for 10 minutes. A Gaulin homogenizer at 3000 psi is used to form the emulsion. The emulsion is reacted at 70° C. for a period of 20 hours using a constant agitation of 125 RPM. Beads are then filtered and washed to remove potassium dichromate. This procedure yields a mean diameter particle of 2.9 micrometers.

Preparation II 23.5 g of Perkadox AMBN (AKZO Chemical) are dissolved in 2348 g of vinyltoluene. In a separate container, 3.32 kg of pH-4 phthalate buffer are added. The pH-4 phthalate buffer is prepared by mixing 200 kg distilled water, 2092 g phthalic acid monopotassium salt and 820 ml of 0.1N HCL from which master batch 3.32 kg are extracted. To the buffer, 0.3 g potassium dichromate, 40.25 g MAEA and 575 g Ludox TM are added. The monomer solution is combined with the aqueous solution and stirred for 10 minutes. A Crepaco Homogenizer is used to form the emulsion which is reacted at 70° C. and 125 RPM overnight. This procedure yields a mean volume size particle of 2.0 micrometers.

EXAMPLES 1A–1G

The procedure of Example I is repeated with the monomers set forth in Table I, the quantities of the various ingredients being in grams per 100 grams of monomer; the mean particle diameter in micrometers is indicated. The particles of Examples 1A, and 1D–1G are prepared following the procedure of Preparation I and the particles of 1B and 1C following the procedure of Preparation II.

EXAMPLE 2

Polymer Suspension 12.75 kg of Makralon (Bisphenol A polycarbonate from Mobay Chemical) is dissolved in 51 kg of dichloromethane. In a separate container is added. 192 kg of the pH-4 master batch of Example I,Preparation II, 75 g AMEA and 3.97 kg Ludox TM. The organic phase is added to the aqueous phase and stirred for 30 minutes. A homogenizer is then used to form the emulsion which is evaporated overnight at atmospheric pressure by blowing nitrogen over the surface. This procedure yields particles having a mean diameter of 4.85 micrometers.

EXAMPLE 3

Control 12.5 g Aerosol OT-100 sold by American Cyanamide and 10 g of Vazo 64 are added to 2 kg of vinyltoluene and stirred until dissolved. 6.37 kg of distilled water is then added and stirred for 15 minutes. The emulsion is formed using a Gaulin colloid mill set at 1 gal/min feed rate, 0.006" gap setting and 3500 RPM. The emulsion is fed into a 12 liter flask and heated to 70° C. while stirring at 100 RPM overnight with a Teflon blade paddle stirrer. This procedure yields particles having a mean diameter of 3.2 micrometers.

EXAMPLES 3A–3C

Controls

The procedure of Example 3 is repeated with the monomers set forth in Table II, the quantities of the various ingredients being in grams per 100 grams of monomer; the mean particle size in micrometers being indicated.

EXAMPLE 4

Adhesion Evaluation

In a mixing vessel combine 1179 grams of Type IV gelatin, as a swollen gelatin which contains 65% water, 1000 grams distilled water, 285.3 grams of a matte dispersion, which consists of 6.75% matte beads (See Table III), 7.5% Type IV gelatin, and the balance distilled water, and 222 grams of a lubricant/gelatin dispersion which contains 9.0% Type IV gelatin.

Each mixture is heated at 46 degrees C. with gentle stirring until the gelatin dissolves completely, (approximately 30 minutes), and a uniform solution is achieved.

Each solution is held at 46 degrees C. and the following addenda are added in the following order:

| | |
|---|---|
| sulfuric acid | 30 cc/pound gelatin |
| Alkanol XC | 13.6 cc/pound of gelatin |
| Surfactant 10G | 14.0 cc/pound of gelatin |
| Fluorad FC135 | 2.0 cc/pound gelatin. |

The solutions are then cooled to 40 degrees C.; the pH adjusted to 5.5 with either a weak acid or base as needed and distilled water added to bring the total weight of the solution to 4761 grams.

The coating compositions are coated onto a photographic support and processed under controlled conditions. A roller is then evaluated for visual appearance and rated on a 1 to 5 scale where 1 is best and 5 indicates considerable matte contamination. This contamination comes from matte which has been removed from the film surface during processing. Additionally, a piece of adhesive tape is used to remove the matte particles from the roller and the number of particles per 4.7 sq cm is counted.

Results are tabulated in Table III in which, only the first four examples in the table are evaluated for visual appearance of the roller while all examples are evaluated by the adhesive tape test.

TABLE I

| Example Number | MONOMERS | g/100 g MONOMER LUDOX TM | MAEA | DICHROMATE | MEAN SIZE (μm) |
|---|---|---|---|---|---|
| 1A | Methylmethacrylate | 80 | 9.33 | 0.013 | 2.03 |
| 1B | Methylmethacrylate (95%) t-butylstyrene (5%) | 55.3 | 1.2 | 0.07 | 1.07 |
| 1C | Vinyltoluene (95%) t-butylstyrene (5%) | 55.3 | 1.2 | 0.07 | 1.80 |
| 1D | Isobutylmethacrylate | 6.2 | 1.33 | 0.0065 | 8.0 |
| 1E | Styrene (70%) Divinylbenzene (30%) | 9.7 | 0.78 | 0.072 | 5.1 |

TABLE I-continued

| Example Number | MONOMERS | g/100 g MONOMER LUDOX TM | MAEA | DICHROMATE | MEAN SIZE (μm) |
|---|---|---|---|---|---|
| 1F | Styrene (70%) Divinylbenzene (30%) | 18.7 | 1.51 | 0.072 | 2.85 |
| 1G | Vinyltoluene | 18.3 | 2.0 | 0.03 | 2.9 |

TABLE II

| EXAMPLE | MONOMER | g/100 g MONOMERS AEROSOL OT-100 | TRITON X-100 | MILL SPEED (RPM) | MEAN SIZE (μm) |
|---|---|---|---|---|---|
| 3A | Methylmethacrylate | 0.18 | — | 2000 | 3.3 |
| 3B | Methylmethacrylate | 0.18 | 0.72 | 2200 | 2.4 |
| 3C | Methylmethacrylate | 0.45 | 2.0 | 3000 | 1.4 |

TABLE III

ROLLER DUST ANALYSIS

| Example | TYPE | LAY-DOWN MG/FT$^2$ | VISUAL APPEAR. | 300X 4.7 SQ CM TAPE COUNT |
|---|---|---|---|---|
| 3 | Vinyltoluene (control) | 3.5 | 4 | 371 |
| 3 | Vinyltoluene (control) | 17 | 5 | 319* |
| 3A | Methylmethacrylate (control) | 17 | 5 | 343 |
| 1G | Vinyltoluene | 17 | 1 | 36 |
| 3A | Methylmethacrylate (control) | 0.5 | — | 138 |
| 1G | Vinyltoluene (control) | 10 | — | 49 |
| 1G | Vinyltoluene | 3.5 | — | 94 |

*Only 0.1 of the entire length of film was process to yield this quantity.

EXAMPLE 5

A cellulose triacetate film support having an antihalation layer on one side and an antistatic layer on the other is coated on the antihalation layer with the following layers in sequence (coverages are in grams per meter squared):

Slow Cyan Dye-Forming Layer

This layer comprises a blend of red-sensitized, cubic, silver bromoiodide emulsion (1.5 mol percent iodide) (0.31 μm grain size) (1.16 g/m$^2$) and red-sensitized, tabular grain, silver bromoiodide emulsion (3 mol percent iodide) (0.75 μm diameter by 0.14 μm thick) (1.31), Compound J (0.965), Compound F (0.011), Compound L (0.65) and gelatin (2.96).

Fast Cyan Dye-Forming Layer

This layer comprises a red-sensitized, tabular grain silver bromoiodide emulsion (6 mol percent iodide having a diameter of 1.40 μm and a thickness of 0.12 μm (0.807), Compound J (0.102), Compound K (0.065), Compound L (0.102) and gelatin (1.506).

Interlayer

This layer comprises Compound F (0.054), an antifoggant and gelatin (1.291).

Slow Magenta Dye-Forming Layer

This layer comprises a blend of green-sensitized tabular grain silver bromoiodide emulsion (3 mol percent iodide) (grain diameter 0.55 μm and thickness 0.08 μm) (0.473) and tabular grain silver bromoiodide emulsion (3 mol percent iodide) (grain diameter 0.52 and thickness 0.09 im) (0.495), Compound G (0.161), Compound I (0.108) and gelatin (2.916).

Fast Magenta Dye-Forming Layer

This layer comprises a blend of green-sensitized tabular grain silver bromoiodide emulsion (3 mol percent iodide) (grain diameter 1.05 μm and thickness 0.12 μm) (0.536) and tabular grain silver bromoiodide emulsion (3 mol percent iodide) (grain diameter 0.75 μm and thickness 0.14 μm), Compound G (0.258), Compound H (0.054) and gelatin (1.119).

Interlayer

This layer comprises Carey-Lea Silver (0.43), Compound F (0.054), an antifoggant and gelatin (0.861).

Slow Yellow Dye-Forming Layer

This layer comprises a blend of blue-sensitized tabular grain silver bromoiodide emulsions (3 mol percent iodide) (grain diameter 0.57 μm and thickness 0.12 μm) (0.274) and blue-sensitive silver bromoiodide emulsion (0.3 mol percent iodide) (grain diameter 0.52 μm and thickness 0.09 μm) (0.118), Compound C (1.022), Compound D (0.168) and gelatin (1.732).

Fast Yellow Dye-Forming Layer

This layer comprises a blue-sensitized tabular grain silver bromoiodide emulsion (3 mol percent iodide) (grain diameter 1.10 μm and thickness 0.12 μm) (0.43), Compound C (0.161), Compound D (0.054), Compound E (0.003) and gelatin (0.791).

UV Absorbing Layer

This layer comprises silver halide Lippmann emulsion (0.215), Compound A (0.108), Compound B (0.106) and gelatin (0.538).

Overcoat

This layer comprises matte particles of Example 1 (0.038) and gelatin (0.888)

The thus prepared photographic film is perforated in 35mm format, exposed in a 35 mm camera and processed in a standard photofinishing processor. The processed film is printed in a standard photofinishing, high speed printer which has roller contact with the overcoat layer containing the matte particles of Example 1. The roller of the printer is removed and inspected for matte particles that dusted from the surface. The roller appears free of matte particles when viewed under an optical microscope.

The structures of the above-designated Compounds A through L are as follows:

A:

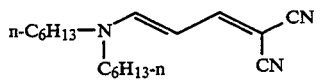

B:

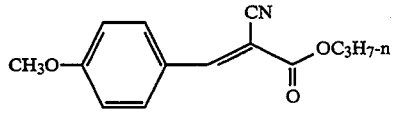

C:

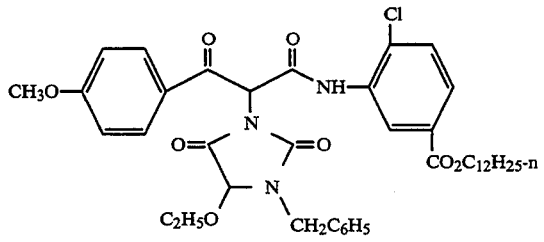

D:

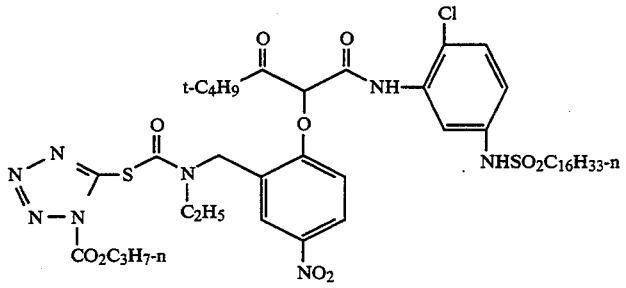

E:

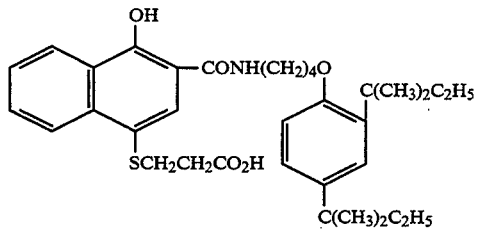

F:

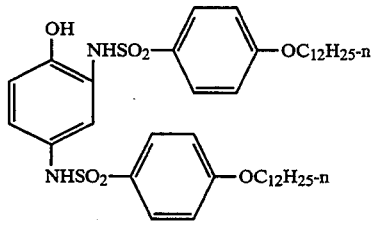

G:

-continued
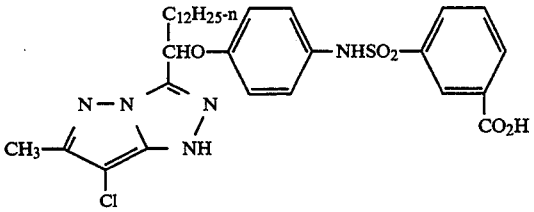
H:
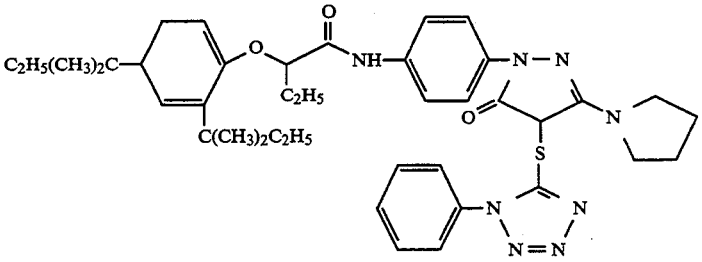
I:
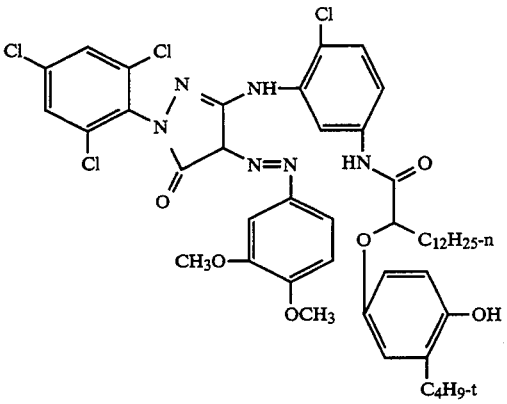
J:
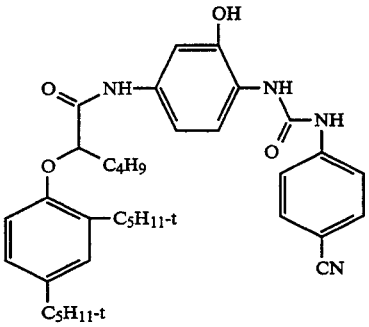
K:
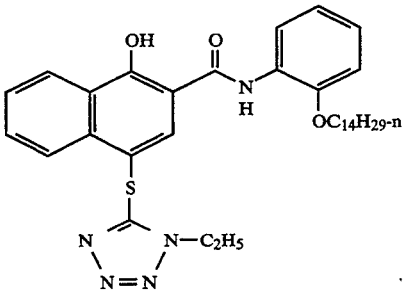
L:

-continued

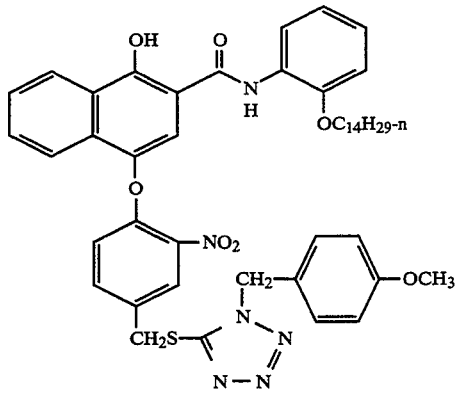

EXAMPLE 6

45 g of Vazo 52 (DuPont) are dissolved in 3316 g of methyl methacrylate and 1421 g of divinylbenzene. In a separate container are mixed 9.0 kg of distilled water, 1.5 g potassium dichromate, 251 g MAEA and 5017 g Lepandin 20 (aluminum oxide from Degussa Chemical). The monomer solution is added to the aqueous solution and stirred for 10 minutes. A Gaulin homogenizer at 3,000 psi is used to form the emulsion which is reacted at 55° C. overnight.

This procedure yields a mean size particle of 2.25 micrometers.

It is to be understood that other polymeric particles surrounded by a uniform layer of colloidal silica may be used throughout the examples in place of the particles particularly employed therein to obtain comparable results.

What is claimed:

1. A photographic element comprising at least one silver halide light-sensitive layer on a support, said element containing polymeric matte particles in at least one gelatin containing layer, said polymeric matte particles having a core surrounded by a layer of colloidal inorganic particles.

2. The photographic element of claim 1 wherein the polymeric matte particles have a mean particle diameter of from 0.5 to 10 micrometers.

3. The photographic element of claim 1 wherein the polymeric matte particles have a mean particle diameter of from 1 to 5 micrometers.

4. The photographic element of claim 1 wherein the polymeric matte particles have a mean particle diameter of from 1 to 3.5 micrometers.

5. The photographic element of claim 1 wherein the polymeric matte particle core is a polyaddition polymer.

6. The photographic element of claim 5 wherein the polyaddition polymer is polyvinyltoluene.

7. The photographic element of claim 1 wherein the polymeric matte particle core is a polycondensation polymer.

8. The photographic element of claim 1 wherein the colloidal inorganic particles are silica, alumina, tin oxide, titanium dioxide, zinc oxide or mixtures thereof.

9. The photographic element of claim 8 wherein the colloidal inorganic particles are silica.

10. The photographic element of claim 9 wherein the polymeric matte particles have a mean particle diameter of from 0.5 to 10 micrometers.

11. The photographic element of claim 9 wherein the polymeric matte particles have a mean particle diameter of from 1 to 5 micrometers.

12. The photographic element of claim 9 wherein the polymeric matte particles have a mean particle diameter of from 1 to 3.5 micrometers.

13. The photographic element of claim 9 wherein the polymeric particle core is a polyaddition polymer.

14. The photographic element of claim 13 wherein the polyaddition polymer is polyvinyltoluene.

15. The photographic element of claim 9 wherein the polymeric particle core is a polycondensation polymer.

16. The photographic element of claim 9 wherein the polymeric matte particles are prepared by limited coalesence.

17. A photographic element comprising at least one silver halide light-sensitive layer on a support, said element containing polymeric matte particles in an overcoat layer, said polymeric matte particles having a core surrounded by a layer of colloidal inorganic particles.

18. The photographic element of claim 16 wherein the colloidal inorganic particles are silica.

* * * * *